US010904659B2

(12) United States Patent
Dyrholm

(10) Patent No.: US 10,904,659 B2
(45) Date of Patent: Jan. 26, 2021

(54) MICROPHONE APPARATUS AND HEADSET

(71) Applicant: GN Audio A/S, Ballerup (DK)

(72) Inventor: Mads Dyrholm, Ballerup (DK)

(73) Assignee: GN Audio A/S, Ballerup (DK)

( * ) Notice: Subject to any disclaimer, the term of this patent is extended or adjusted under 35 U.S.C. 154(b) by 0 days.

(21) Appl. No.: 16/710,947

(22) Filed: Dec. 11, 2019

(65) Prior Publication Data

US 2020/0213726 A1 Jul. 2, 2020

(30) Foreign Application Priority Data

Dec. 31, 2018 (EP) ..... 18215941

(51) Int. Cl.
*H04R 3/00* (2006.01)
*H04R 1/08* (2006.01)
*H04R 1/10* (2006.01)

(52) U.S. Cl.
CPC ..... *H04R 3/005* (2013.01); *H04R 1/083* (2013.01); *H04R 1/1008* (2013.01); *H04R 2203/12* (2013.01)

(58) Field of Classification Search
CPC ..... H04R 3/005; H04R 1/083; H04R 1/1008; H04R 2203/12; H04R 2201/107; G10L 2021/02166
See application file for complete search history.

(56) References Cited

FOREIGN PATENT DOCUMENTS

| | | |
|---|---|---|
| EP | 2701145 | 2/2014 |
| EP | 2882203 | 6/2015 |
| EP | 3101919 | 12/2016 |

OTHER PUBLICATIONS

Extended European Search Report for European patent application No. 18215941.8 dated Jun. 19, 2019.

*Primary Examiner* — Ping Lee
(74) *Attorney, Agent, or Firm* — Hamre, Schumann, Mueller & Larson, P.C.

(57) ABSTRACT

The present invention relates to a microphone apparatus (30) with a main beamformer (31) that provides a main output audio signal ($S_M$) as a beamformed signal by applying a main weight vector ($B_M$) to a main input vector ($M_M$). A main beamformer controller (32) repeatedly determines a main steering vector ($d_M$) and adaptively determines the main weight vector ($B_M$) in dependence on the main steering vector ($d_M$) and the main input vector ($M_M$) to increase the relative amount of voice sound (V) from the user (6) in the main output audio signal ($S_M$).

The microphone apparatus (30) further comprises an auxiliary beamformer (33) that provides an auxiliary beamformer signal ($S_F$) as a beamformed signal by applying an auxiliary weight vector ($B_F$) to an auxiliary input vector ($M_A$) that is a subset of the main input vector ($M_M$), and an auxiliary beamformer controller (34) that adaptively determines the auxiliary weight vector ($B_F$) to increase the relative amount of voice sound (V) from the user (6) in the auxiliary beamformer signal ($S_F$). The main beamformer controller (32) determines the main steering vector ($d_M$) in dependence on the auxiliary weight vector ($B_F$).

This may enable the main beamformer controller (32) to utilize information derived independently of the steering vector ($d_M$) and may thus improve stability and/or accuracy of the estimation of the steering vector ($d_M$), and may further reduce the computation load for the main beamformer controller (32).

15 Claims, 5 Drawing Sheets

MICROPHONE APPARATUS AND HEADSET

TECHNICAL FIELD

The present invention relates to a microphone apparatus and more specifically to a microphone apparatus with a beamformer that provides a directional audio output by combining microphone signals from multiple microphones. The present invention also relates to a headset with such a microphone apparatus. The invention may e.g. be used to enhance speech quality and intelligibility in headsets and other audio devices.

BACKGROUND ART

In the prior art, it is known to filter and combine signals from two or more spatially separated microphones to obtain a directional microphone signal. This form of signal processing is generally known as beamforming. The quality of beamformed microphone signals depends on the individual microphones having equal sensitivity characteristics across the relevant frequency range, which, however, is challenged by finite production tolerances and variations in aging of components. The prior art therefore comprises various techniques directed to calibrate microphones or otherwise handle deviating microphone characteristics in beamformers.

Also, adaptive alignment of the beam of a beamformer to varying locations of a target sound source is known in the art. An example of an adaptive beamformer is the so-called "General Sidelobe Canceller" or GSC. The GSC separates the adaptive beamformer into two main processing paths. The first of these implements a standard fixed beamformer, with constraints on the desired signal. The second path implements an adaptive beamformer, which provides a set of filters that adaptively minimize the power in the output. The desired signal is eliminated from the second path by a blocking matrix, ensuring that it is the noise power that is minimized. The output of the second path (the noise) is subtracted from the output of the fixed beamformer to provide the desired signal with less noise. The GSC is an example of a so-called "Linearly Constrained Minimum Variance" or LCMV beamformer. Use of the GSC requires that the direction to the desired source is known.

Furthermore, a general problem for many adaptive beamformer algorithms is the determination of when the microphone input signals comprise the desired signal.

European Patent Application EP 18205678.8 discloses a microphone apparatus with a main beamformer operating on input audio signals from a first and a second microphone unit. The microphone apparatus comprises a suppression beamformer operating on the same two input audio signals to provide a suppression beamformer signal and a suppression filter controller that controls the suppression beamformer to minimize the suppression beamformer signal. The microphone apparatus further comprises a candidate beamformer operating on the same two input audio signals to provide a candidate beamformer signal and a candidate filter controller that controls the candidate beamformer to have a transfer function equaling the complex conjugate of a transfer function of the suppression beamformer. The microphone apparatus controls a transfer function of the main beamformer to converge towards the transfer function of the candidate beamformer in dependence on determined voice activity in the candidate beamformer signal. The disclosure does, however, only mention beamformers operating on input audio signals from two microphone units.

There is thus still a need for improvement.

DISCLOSURE OF INVENTION

It is an object of the present invention to provide an improved microphone apparatus without some disadvantages of prior art apparatuses. It is a further object of the present invention to provide an improved headset without some disadvantages of prior art headsets.

These and other objects of the invention are achieved by the invention defined in the independent claims and further explained in the following description. Further objects of the invention are achieved by embodiments defined in the dependent claims and in the detailed description of the invention.

Within this document, the singular forms "a", "an", and "the" specify the presence of a respective entity, such as a feature, an operation, an element or a component, but do not preclude the presence or addition of further entities. Likewise, the words "have", "include" and "comprise" specify the presence of respective entities, but do not preclude the presence or addition of further entities. The term "and/or" specifies the presence of one or more of the associated entities. The steps or operations of any method disclosed herein need not be performed in the exact order disclosed, unless expressly stated so.

BRIEF DESCRIPTION OF THE DRAWINGS

The invention will be explained in more detail below together with preferred embodiments and with reference to the drawings in which.

The figures are schematic and simplified for clarity, and they just show details essential to understanding the invention, while other details may be left out. Where practical, like reference numerals and/or labels are used for identical or corresponding parts.

MODE(S) FOR CARRYING OUT THE INVENTION

Figure 1:
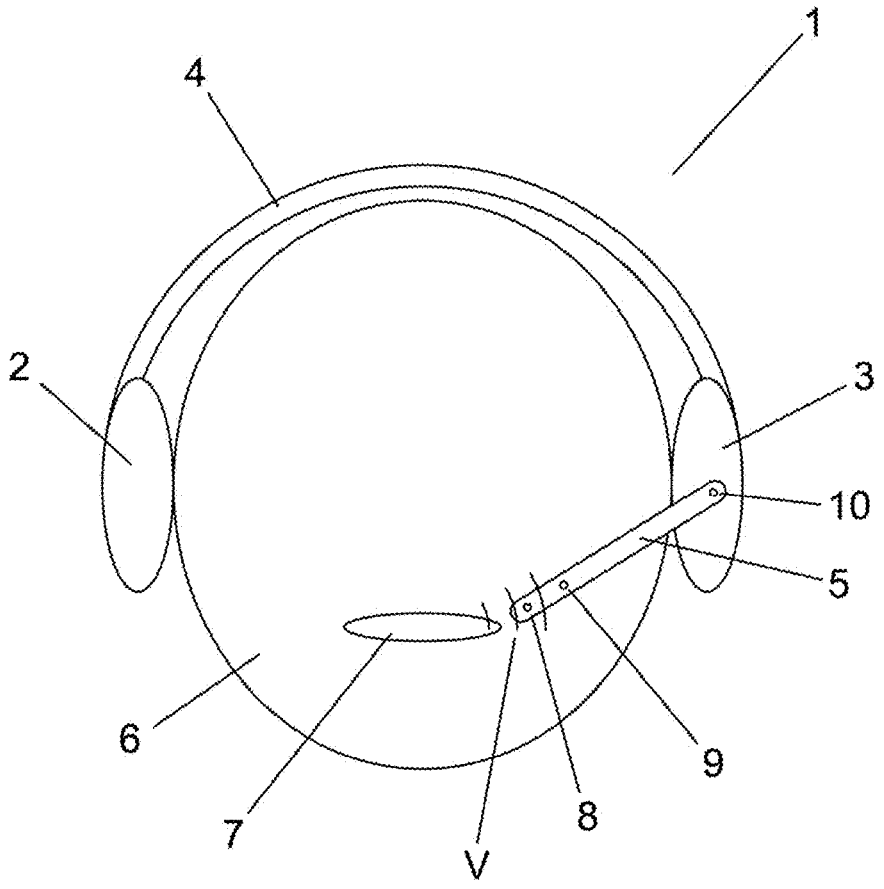
FIG. 1 shows an embodiment of a headset.

The headset 1 shown in FIG. 1 comprises a right-hand side earphone 2, a left-hand side earphone 3, a headband 4 mechanically interconnecting the earphones 2, 3 and a microphone arm 5 mounted at the left-hand side earphone 3. The headset 1 is designed to be worn in an intended wearing position on the head of a user 6 with the earphones 2, 3 arranged at the user's respective ears and the microphone arm 5 extending from the left-hand side earphone 3 towards the user's mouth 7. The microphone arm 5 has a first sound inlet 8 and a second sound inlet 9 for receiving voice sound V from the user 6. The left-hand side earphone 3 has a third sound inlet 10 for receiving voice sound V from the user 6.

In the following, the location of the user's mouth 7, i.e. the source of the voice sound V, relative to the sound inlets 8, 9, 10 may be referred to as "speaker location". The headset 1 may preferably be designed such that when the headset is worn in the intended wearing position, a first one of the first and second sound inlets 8, 9 is closer to the user's mouth 7 than the respective other sound inlet 8, 9. The headset 1 may preferably comprise a microphone apparatus as described in the following. Also other types of headsets may comprise such a microphone apparatus, e.g. a headset as shown but with only one earphone 2, 3, a headset with the microphone arm 5 extending from the right-hand side earphone 2, a headset with other wearing components than a headband, such as e.g. a neck band, an ear hook or the like, or a headset without a microphone arm 5; in the latter case, the first and second sound inlets 8, 9 may be arranged e.g. at an earphone 2, 3 or on respective earphones 2, 3 of a headset. The third sound inlet 10 may alternatively be arranged otherwise, e.g. at the right-hand side earphone 2 or at the microphone arm 5. The third sound inlet 10 may e.g. be arranged to pick up sound near or in the concha and/or the ear canal of the user's ear.

Figure 2:
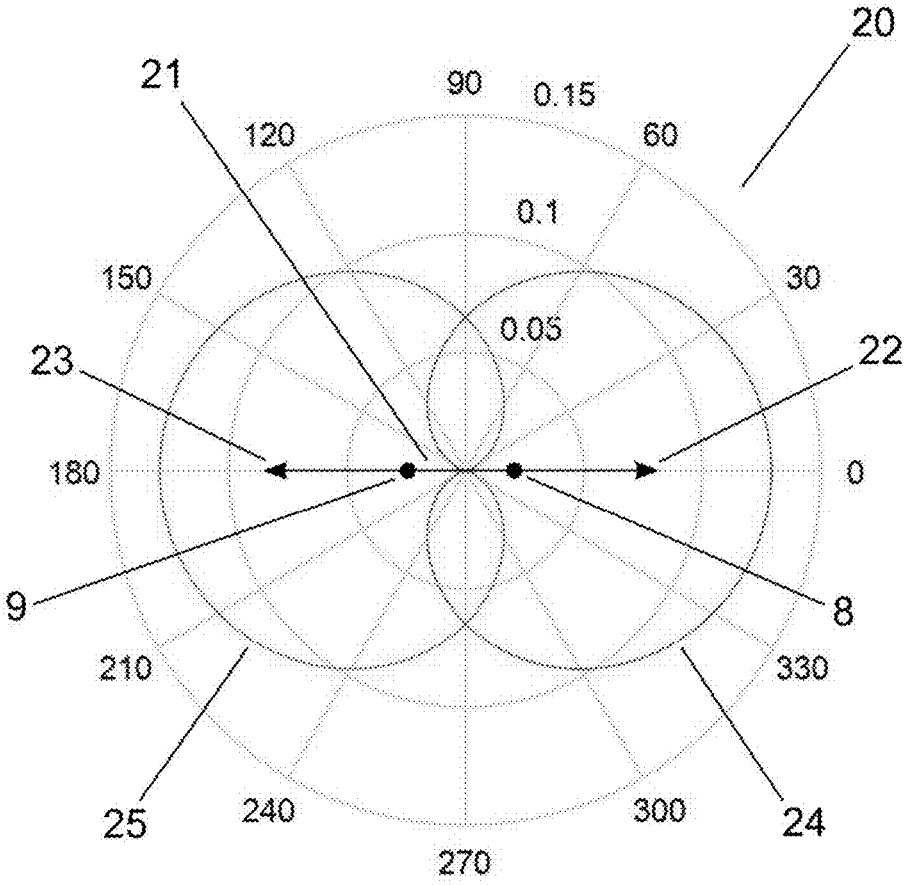
FIG. 2 shows example directional characteristics.

The polar diagram 20 shown in FIG. 2 defines relative spatial directions referred to in the present description. A straight line 21 extends through the first and the second sound inlets 8, 9. The direction indicated by arrow 22 along the straight line 21 in the direction from the second sound inlet 9 through the first sound inlet 8 is in the following referred to as "forward direction". The opposite direction indicated by arrow 23 is referred to as "rearward direction". An example cardioid directional characteristic 24 with a null in the rearward direction 23 is in the following referred to as "forward cardioid". An oppositely directed cardioid directional characteristic 25 with a null in the forward direction 22 is in the following referred to as "rearward cardioid".

Figure 3:
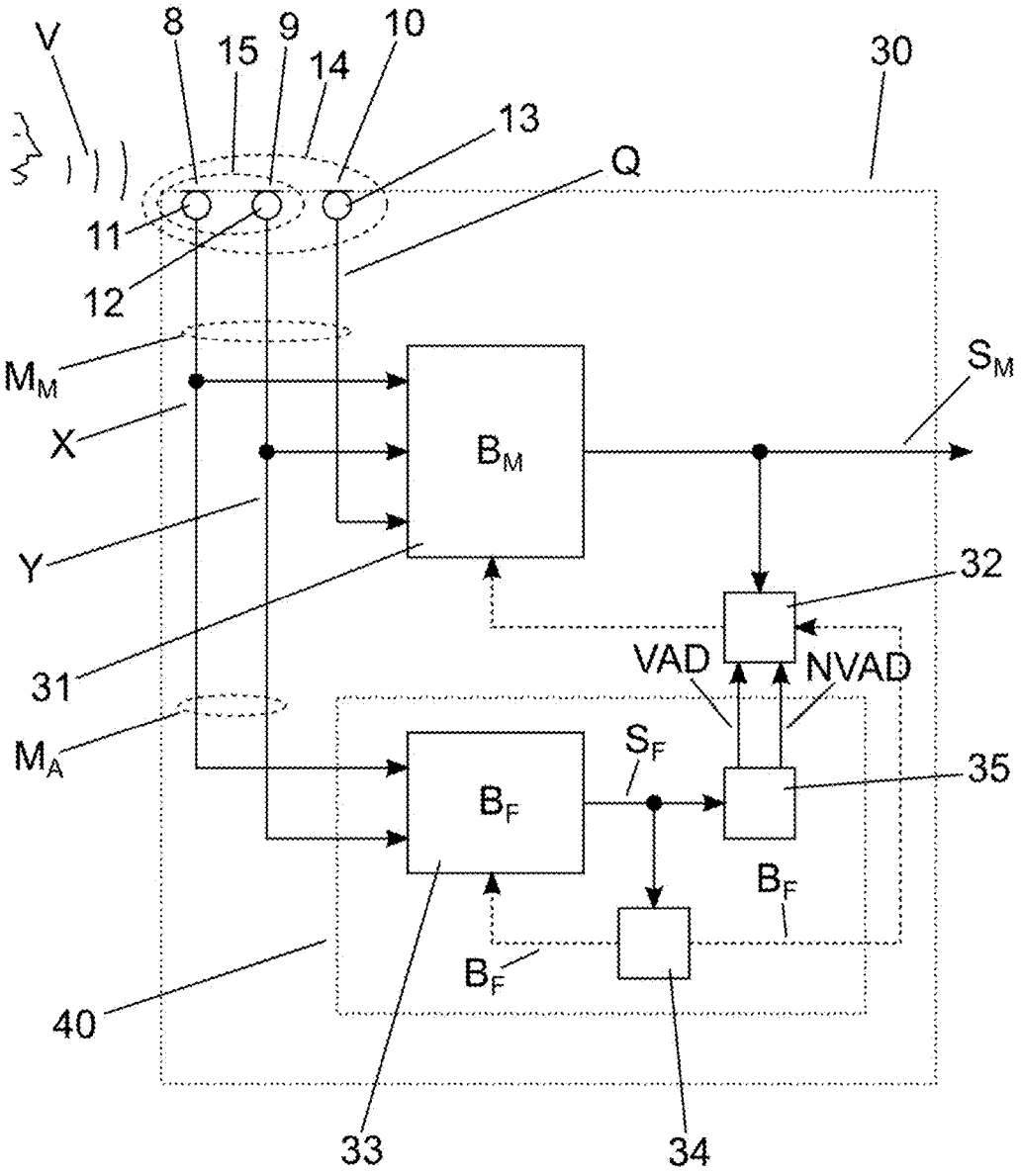
FIG. 3 shows an embodiment of a microphone apparatus.

The microphone apparatus 30 shown in FIG. 3 comprises a first microphone unit 11, a second microphone unit 12, a third microphone unit 13, a main beamformer 31, a main beamformer controller 32 and an auxiliary controller 40 comprising an auxiliary beamformer 33, an auxiliary beamformer controller 34 and an auxiliary voice detector 35. The microphone apparatus 30 provides an output audio signal $S_M$ in dependence on voice sound V received from a user 6 of the microphone apparatus. The microphone apparatus 30 may be comprised by an audio device, such as e.g. a headset like the headset 1 shown in FIG. 1, a hearing aid, a speakerphone device, a stand-alone microphone device or the like. Correspondingly, the microphone apparatus 30 may comprise further functional components for audio processing, such as e.g. noise reduction, echo suppression, voice enhancement etc., and/or wired or wireless transmission of the output audio signal $S_M$. The output audio signal $S_M$ may be transmitted as a speech signal to a remote party, e.g. through a communication network, such as e.g. a telephony network or the Internet, or be used locally, e.g. by voice recording equipment or a public-address system.

The first microphone unit 11 provides a first input audio signal X in dependence on sound received at a first sound inlet 8, the second microphone unit 12 provides a second input audio signal Y in dependence on sound received at a second sound inlet 9 spatially separated from the first sound inlet 8, and the third unit 13 provides a third input audio signal Q in dependence on sound received at a third sound inlet 10 spatially separated from the first sound inlet 8 and the second sound inlet 9. Where the microphone apparatus 30 is comprised by a small device, like a stand-alone microphone, a microphone arm 5 or an earphone 2, 3, the spatial separation between the sound inlets 8, 9, 10 is normally chosen within the range 5-30 mm, but larger or smaller spacing may be used.

The microphone apparatus 30 may preferably be designed to nudge or urge a user 6 to arrange the microphone apparatus 30 in a position with the first sound inlet 8 closer to the user's mouth 7 than the second sound inlet 9. Where the microphone apparatus 30 is comprised by a headset 1 with a microphone arm 5 extending from an earphone 3, the first and second sound inlets 8, 9 may thus e.g. be located at the microphone arm 5 with the first sound inlet 8 arranged further away from the earphone 3 than the second sound inlet 9.

The first, the second and the third microphone unit 11, 12, 13 constitute a main microphone array 14, with an output in the form of a vector. The main microphone array 14 thus provides as output a main input vector $M_M$=(X, Y, Q) comprising as components the first, the second and the third input audio signal X, Y, Q.

The main beamformer 31 determines the main output audio signal $S_M$ as already known in the technical field of filter-sum beamformers. The main beamformer 31 applies a first main weight function $B_{MX}$ to the first input audio signal X to provide a first main weighted signal $B_{MX}X$, applies a second main weight function $B_{MY}$ to the second input audio signal Y to provide a second main weighted signal $B_{MY}Y$, and applies a third main weight function $B_{MQ}$ to the third input audio signal Q to provide a third main weighted signal $B_{MQ}Q$, wherein the first, the second and the third main weight function $B_{MX}$, $B_{MY}$, $B_{MQ}$ differ from each other. The main beamformer 31 provides the main output audio signal $S_M$ by summing the first, the second and the third main weighted signal $B_{MX}X$, $B_{MY}Y$, $B_{MQ}Q$.

The main beamformer 31 may perform the above beamformer computations in different ways and still arrive at the same result. In the present context, the action of applying a specific weight vector to a specific input vector shall be defined to include all computation algorithms and/or structures that yield the same result as performing element-by-element multiplication of the two vectors and summation of the multiplication results as described above. The main beamformer 31 thus provides the main output audio signal $S_M$ as a beamformed signal by applying a main weight vector $B_M$=($B_{MX}$, $B_{MY}$, $B_{MQ}$) comprising as components the first, the second and the third main weight function $B_{MX}$, $B_{MY}$, $B_{MQ}$ to the main input vector $M_M$.

In the present context, a weight vector is an ordered set of weight functions, wherein the weight functions are ordered by the components of the input vector to which they apply, and wherein a weight function is a frequency-dependent transfer function. A weight function is normally a complex transfer function, and the weight functions of a weight vector normally differ from each other. Note, however, that a weight vector may be normalized so that one of its weight functions equals the unity function.

The main beamformer controller 32 repeatedly determines a main steering vector $d_M$=($d_{MX}$, $d_{MY}$, $d_{MQ}$) and adaptively determines the main weight vector $B_M$ in dependence on the main steering vector $d_M$ and the main input vector $M_M$ to increase the relative amount of voice sound V from the user 6 in the main output audio signal $S_M$, wherein the main steering vector $d_M$ indicates a desired, preferably undistorted, response of the main beamformer 31. The steering vector $d_M$ thus has a respective component $d_{MX}$, $d_{MY}$, $d_{MQ}$ for each of the components X, Y, Q of the main input vector $M_M$. The steering vector $d_M$ is an ordered set of weight functions, wherein the weight functions are ordered by the components of the input vector to which they apply, and wherein a weight function is a frequency-dependent transfer function. A weight function is normally a complex transfer function, and the weight functions of the steering vector $d_M$ normally differ from each other.

The main beamformer controller 32 preferably operates according to the widely used Minimum Variance Distortionless Response (MVDR) beamformer algorithm. The MVDR beamformer algorithm is an adaptive beamforming algorithm whose goal is to minimize the variance of the beamformer output signal while maintaining an undistorted response towards a desired signal, i.e. the voice sound V. If the desired signal and the undesired noise are uncorrelated, then the variance of the beamformer output signal equals the sum of the variances of the desired signal and the noise. The MVDR beamformer algorithm seeks to minimize this sum, thereby reducing the effect of the noise, preferably by estimating a noise covariance matrix for the main input vector $M_M$ and using the estimated noise covariance matrix in the computation of the components $B_{MX}$, $B_{MY}$, $B_{MQ}$ of the main weight vector $B_M$ as well known in the art.

The MVDR beamformer algorithm takes as inputs the steering vector $d_M$ and an estimated noise covariance matrix for the main input vector $M_M$. The steering vector $d_M$ defines the desired response of the main beamformer 31. In the present context, the desired signal is the voice sound V, and the desired response thus equals the response of the main beamformer 31 when the main input vector $M_M$ only contains voice sound V of the user 6. The steering vector $d_M$ may thus easily be computed from the main input vector $M_M$ when it only contains voice sound V of the user 6. It is, however, difficult to determine when the main input vector $M_M$ only contains voice sound V of the user 6, and accurate determination of the steering vector $d_M$ is thus also difficult. Errors in the steering vector $d_M$ may cause the main beamformer 31 to distort the voice sound V in the main output audio signal $S_M$, particularly if the errors represent deviations in the sensitivity of the microphone units 11, 12, 12 or in the locations of the sound inlets 8, 9, 10.

In the prior art, it is known to analyse the main output audio signal $S_M$ to detect voice sound V and to estimate the steering vector $d_M$ in dependence on the detected voice sound V. It is also known to detect voice sound V by computing the correlation between the main output audio signal $S_M$ and a microphone signal known to include mainly voice sound V. Both methods do, however, introduce an inherent instability and/or inaccuracy caused by the steering vector $d_M$ being, at least partly, circularly dependent on itself.

To mitigate the above-mentioned problems of MVDR and similar beamformers, the main beamformer controller 32 determines the steering vector $d_M$ in dependence on an auxiliary weight vector $B_F=(B_{FX}, B_{FY})$ determined for the auxiliary beamformer 33 by the auxiliary beamformer controller 34. This may enable the main beamformer controller 32 to utilize further information derived independently of the steering vector $d_M$ and may thus improve stability and/or accuracy of the estimation of the steering vector $d_M$, and may further reduce the computation load for the main beamformer controller 32. Furthermore, the auxiliary beamformer 33 preferably operates on a proper subset of the input audio signals X, Y, Q on which the main beamformer 31 operates, which may cause the auxiliary beamformer 33 to have less degrees of freedom than the main beamformer 31. This may further cause the auxiliary beamformer controller 34 to have an easier task in accurately determining the auxiliary weight vector $B_F$ than the main beamformer controller 32 has in accurately determining the steering vector $d_M$. The main beamformer controller 32 may determine the steering vector $d_M$ in dependence on the auxiliary weight vector $B_F$ only during start-up of the beamformer, e.g. until the main weight vector $B_M$ has stabilized, which may easily be detected by the main beamformer controller 32 in known ways. When the main beamformer controller 32 detects disturbances, it may then return to determining the steering vector $d_M$ in dependence on the auxiliary weight vector $B_F$.

The auxiliary beamformer 33 applies a first auxiliary weight function $B_{FX}$ to the first input audio signal X to provide a first auxiliary weighted signal $B_{FX}X$, applies a second auxiliary weight function $B_{FY}$ to the second input audio signal Y to provide a second auxiliary weighted signal $B_{FY}Y$, and provides an auxiliary beamformer signal $S_F$ by summing the first and the second auxiliary weighted signal $B_{FX}X$, $B_{FY}Y$. The auxiliary beamformer 33 thus provides the auxiliary beamformer signal $S_F$ as a beamformed signal by applying the auxiliary weight vector $B_F$ comprising as components the first and the second auxiliary weight function $B_{FX}$, $B_{FY}$ to an auxiliary input vector $M_A=(X, Y)$ comprising as components the first and the second input audio signal X, Y. The first and the second microphone unit 11, 12 thus constitute an auxiliary microphone array 15 that provides the auxiliary input vector $M_A=(X, Y)$ comprising as components the first and the second input audio signal X, Y. The auxiliary microphone array 15 preferably comprises a proper subset of the microphone units 11, 12, 13 of the main microphone array 14, meaning that the main microphone array 14 comprises at least one microphone unit 11, 12, 13 that is not comprised by the auxiliary microphone array 15. Correspondingly, the auxiliary input vector $M_A$ is preferably a proper subvector of the main input vector $M_M$. The auxiliary beamformer controller 34 adaptively determines the auxiliary weight vector $B_F$ to increase the relative amount of voice sound V from the user 6 in the auxiliary beamformer signal $S_F$. The auxiliary voice detector 35 preferably applies a predefined voice measure function A to the auxiliary beamformer signal $S_F$ to determine an auxiliary voice measure $V_F$ of voice sound V in the auxiliary beamformer signal $S_F$, wherein the voice measure function A is chosen to correlate with voice sound V in its input signal $S_F$, and the auxiliary beamformer controller 34 may preferably determine the auxiliary weight vector $B_F$ in dependence on the auxiliary voice measure $V_F$. The voice measure function A and the auxiliary voice measure $V_F$ are preferably frequency-dependent functions.

In some embodiments, the main beamformer controller 32 may determine the steering vector component $d_{MX}$ for the first input audio signal X to be equal to, or converge towards being equal to, the first auxiliary weight function $B_{FX}$ and determine the steering vector component $d_{MY}$ for the second input audio signal Y to be equal to, or converge towards being equal to, the second auxiliary weight function $B_{FY}$. To complete the steering vector $d_M$, the main beamformer controller 32 then only needs to determine the steering vector component $d_{MQ}$ for the third input audio signal Q. The main beamformer controller 32 may determine the steering vector component $d_{MQ}$ for the third input audio signal Q based on the main output audio signal $S_M$ as known in the prior art.

Alternatively, or additionally, the main beamformer controller 32 may determine the steering vector $d_M$ in dependence on the auxiliary voice measure $V_F$. The auxiliary voice detector 35 may derive a user-voice activity signal VAD from the auxiliary voice measure $V_F$ such that the user-voice activity signal VAD indicates voice activity when the main input vector $W_M$ only, or mainly, contains voice sound V of the user 6, and the main beamformer controller 32 may determine one or more components $d_{MX}$, $d_{MV}$, $d_{MQ}$ of the steering vector $d_M$ from values of the main input vector $M_M$ collected during periods wherein the user-voice activity signal VAD indicates voice activity. The main beamformer controller 32 may further restrict modification of the steering vector $d_M$ to periods wherein the user-voice activity signal VAD indicates voice activity. The user-voice activity signal VAD may be a frequency-dependent function, and the main beamformer controller 32 may determine the steering vector $d_M$ in dependence on the auxiliary voice measure $V_F$ only for frequency bands or frequency bins wherein the user-voice activity signal VAD indicates voice activity and/or restrict other voice-based modification of the steering vector $d_M$ to such frequency bands or frequency bins. For other frequency bands or frequency bins, the main beamformer controller 32 may determine the steering vector $d_M$ based on the main output audio signal $S_M$ as known in the prior art.

The main beamformer controller 32 may further determine the main weight vector $B_M$ in dependence on the auxiliary voice measure $V_F$. The auxiliary voice detector 35 may derive a no-user-voice activity signal NVAD from the auxiliary voice measure $V_F$ such that the no-user-voice activity signal NVAD indicates the absence of voice activity when the main input vector $M_M$ not, or nearly not, contains voice sound V of the user 6, and the main beamformer controller 32 may determine the main weight vector $B_M$ in dependence on values of the main input vector $M_M$ collected during periods wherein the no-user-voice activity signal NVAD indicates the absence of voice activity. The main beamformer controller 32 may further restrict noise-based modification of the main weight vector $B_M$ to periods wherein the no-user-voice activity signal NVAD indicates the absence of voice activity. The no-user-voice activity signal NVAD may be a frequency-dependent function, and the main beamformer controller 32 may determine the main weight vector $B_M$ based on noise estimates only for frequency bands or frequency bins wherein the no-user-voice activity signal NVAD indicates the absence of voice activity and/or restrict noise-based modification of the main weight vector $B_M$ to such frequency bands or frequency bins.

In some embodiments, the main beamformer controller 32 may determine the steering vector $d_M$ to be congruent with, or converge towards being congruent with, the auxiliary weight vector $B_F$. In the present context, two vectors are considered congruent if and only if one of them can be obtained by a linear scaling of the respective other one, wherein linear scaling encompasses scaling by any factor or frequency-dependent function, which may be real or complex, including the factor one as well as factors and functions with negative values, and wherein components that are only present in one of the vectors are disregarded. In the embodiment shown, the steering vector $d_M$ is thus considered congruent with the auxiliary weight vector $B_F$ if and only if the steering vector component $d_{MX}$ for the first input audio signal X can be obtained by a linear scaling of the weight function $B_{FX}$ for the first input audio signal X and the steering vector component $d_{MY}$ for the second input audio signal Y can be obtained by a linear scaling of the weight function $B_{FY}$ for the second input audio signal Y using one and the same scaling factor or function. The main beamformer controller 32 may e.g. determine the steering vector $d_M$ based on the main output audio signal $S_M$ as known in the prior art and by applying the congruence constraint in the determination.

The auxiliary beamformer controller 34 may determine the auxiliary weight vector $B_F$ based on any of the many known methods for determining an optimum two-microphone beamformer. However, the auxiliary beamformer controller 34 may determine the auxiliary weight vector $B_F$ based on a preferred embodiment of the auxiliary controller 40 as described in the following.

Figure 4:
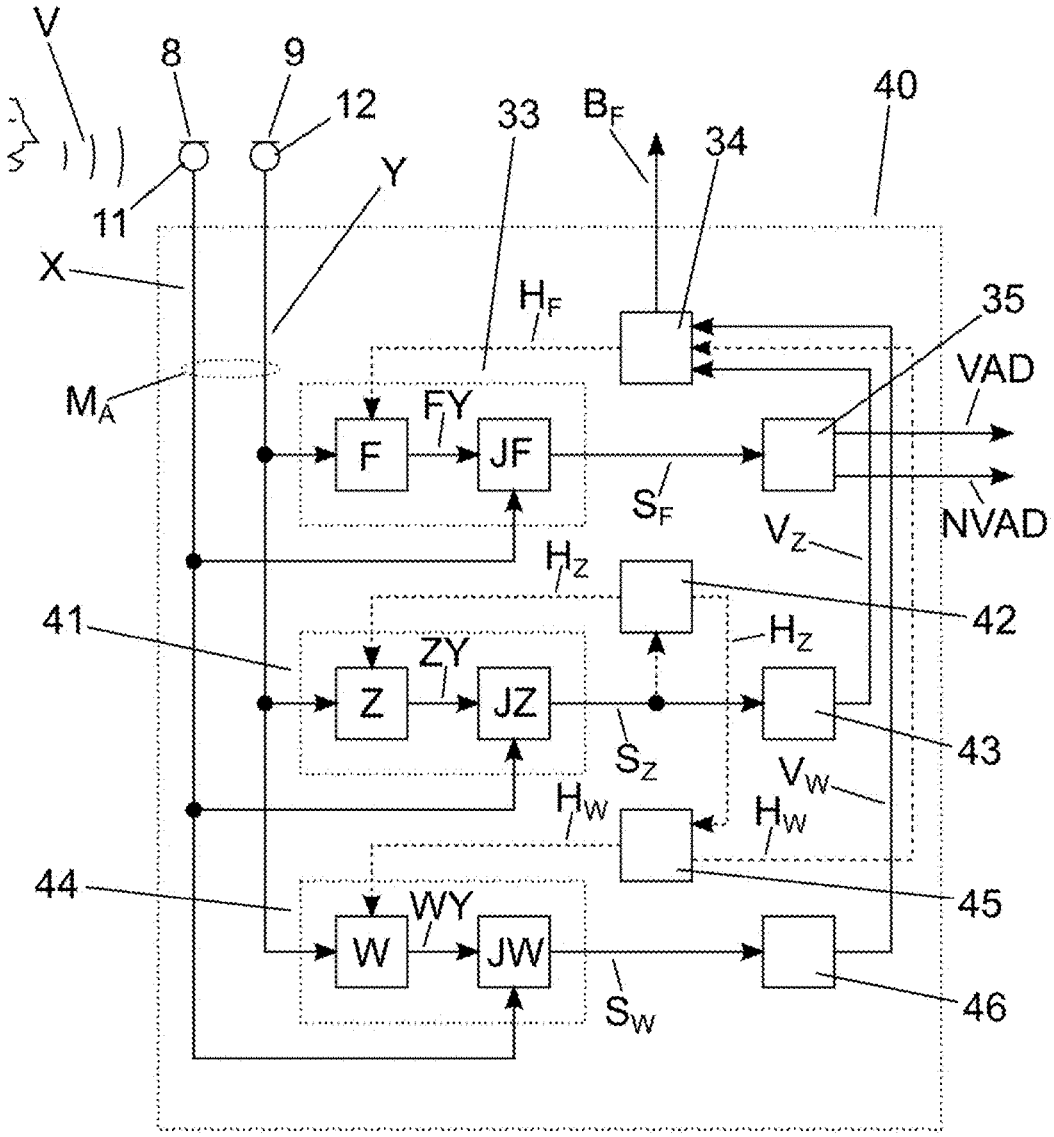
FIG. 4 shows an embodiment of an auxiliary controller.

The auxiliary controller 40 shown in FIG. 4 comprises the auxiliary beamformer 33, the auxiliary beamformer controller 34 and the auxiliary voice detector 35 as shown in FIG. 3 and further comprises a null beamformer 41, a null beamformer controller 42, a null voice detector 43, a candidate beamformer 44, a candidate beamformer controller 45 and a candidate voice detector 46. The auxiliary beamformer 33, the null beamformer 41 and the candidate beamformer 44 are preferably implemented as single-filter beamformers, meaning that their weight vectors each comprise only one frequency-dependent component. Thus, the auxiliary beamformer 33 comprises an auxiliary filter F and an auxiliary mixer JF, the null beamformer 41 comprises a null filter Z and a null mixer JZ, and the candidate beamformer 44 comprises a candidate filter W and a candidate mixer JW.

The auxiliary filter F is a linear filter with an auxiliary transfer function $H_F$. The auxiliary filter F provides an auxiliary filtered signal FY in dependence on the second input audio signal Y, and the auxiliary mixer JF is a linear mixer that provides the auxiliary beamformer signal $S_F$ as a beamformed signal in dependence on the first input audio signal X and the auxiliary filtered audio signal FY. The auxiliary filter F and the auxiliary mixer JF thus cooperatively constitute the linear auxiliary beamformer 33 as generally known in the art.

The null filter Z is a linear filter with a null transfer function $H_Z$. The null filter Z provides a null filtered signal ZY in dependence on the second input audio signal Y, and the null mixer JZ is a linear mixer that provides the null beamformer signal $S_Z$ as a beamformed signal in dependence on the first input audio signal X and the null filtered signal ZY. The null filter Z and the null mixer JZ thus cooperatively constitute the linear null beamformer 41 as generally known in the art.

The candidate filter W is a linear filter with a candidate transfer function $H_W$. The candidate filter W provides a candidate filtered signal WY in dependence on the second input audio signal Y, and the candidate mixer JW is a linear mixer that provides the candidate beamformer signal $S_W$ as a beamformed signal in dependence on the first input audio signal X and the candidate filtered signal WY. The candidate filter W and the candidate mixer JW thus cooperatively constitute the linear candidate beamformer 44 as generally known in the art.

Depending on the intended use of the microphone apparatus 30, the first microphone unit 11 and the second microphone unit 12 may each comprise an omnidirectional microphone, in which case each of the auxiliary beamformer 33, the null beamformer 41 and the candidate beamformer 44 will cause their respective output signal $S_F$, $S_Z$, $S_W$ to have a second-order directional characteristic, such as e.g. a forward cardioid 24, a rearward cardioid 25, a supercardioid, a hypercardioid, a bidirectional characteristic or any of the other well-known second-order directional characteristics. A directional characteristic is normally used to suppress unwanted sound, i.e. noise, in order to enhance desired sound, such as voice sound V from a user 6 of a device 1, 30. The directional characteristic of a beamformed signal typically depends on the frequency of the signal.

Generally, when two beamformers operating on the same input vector have identical shape of their directional characteristics, then their weight vectors are congruent. If they are both implemented as equally configured single-filter beamformers operating on the same two microphone input signals, then the transfer functions of their filters will be equal.

In the following, it is assumed that each of the auxiliary mixer 1F, the null mixer 1Z and the candidate mixer JW simply subtracts respectively the auxiliary filtered signal FY, the null filtered signal ZY and the candidate filtered signal WY from the first input audio signal X to obtain respectively the auxiliary beamformer signal $S_F$, the null beamformer signal $S_Z$ and the candidate beamformer signal $S_W$. This corresponds to applying respectively the auxiliary weight vector $B_F$, a null weight vector $B_Z$ and a candidate weight vector $B_W$, to the auxiliary input vector $M_A$, wherein the auxiliary weight vector components ($B_{FX}$, $B_{FY}$) equal (1, $-H_F$), the null weight vector components ($B_{ZX}$, $B_{ZY}$) equal (1, $-H_Z$) and the candidate weight vector components ($B_{WX}$, $B_W$) equal (1, $-H_W$). In some embodiments, one or more of the mixers JF, JZ, JW may be configured to apply other or further linear operations, such as e.g. scaling, inversion and/or summing instead of subtraction, and in such embodiments, the respective weight vectors $B_F$, $B_Z$, $B_W$ may differ from the ones shown here, but will still be congruent with them. In this case, the respective transfer functions $H_F$, $H_Z$, $H_W$, of the beamformer filters will also be congruent with the ones shown here, meaning that the respective transfer function $H_F$, $H_Z$, $H_W$ can be obtained by a linear scaling of the one shown here, wherein linear scaling encompasses scaling by any non-frequency-dependent factor, which may be real or complex, including the factor one and factors with negative values. Also, two filters are considered congruent if and only if their transfer functions are congruent.

The auxiliary beamformer controller 34 adaptively determines the auxiliary transfer function $H_F$ of the auxiliary filter F to increase the relative amount of voice sound V in the auxiliary beamformer signal $S_F$. The auxiliary beamformer controller 34 preferably does this based on information derived from the first input audio signal X and the second input audio signal Y as described in the following. This adaptation of the auxiliary transfer function $H_F$ changes the directional characteristic of the auxiliary beamformer signal $S_F$.

In a first step, the null beamformer controller 42 determines the null transfer function $H_Z$ of the null filter Z to minimize the null beamformer signal $S_Z$. The prior art knows many algorithms for achieving such minimization, and the null beamformer controller 42 may in principle apply any such algorithm. A preferred embodiment of the null beamformer controller 42 is described further below. When the auxiliary input vector $M_A$ only or mainly comprises voice sound V from the user, or when the noise comprised by the auxiliary input vector $M_A$ is steady and spatially omnidirectional, then the minimization will cause the voice sound V to be decreased or suppressed in the null filtered signal $S_Z$. The null beamformer controller 42 thus adaptively determines the null weight vector $B_Z$ to decrease or minimize the relative amount of voice sound V from the user 6 in the null beamformer signal $S_Z$.

In an ideal case with the first and second audio input signals X, Y having equal delays relative to the sound at the respective sound inlets 8, 9, with steady broad-spectred voice sound V arriving from the far-field and exactly (and only) from the forward direction 22 and with steady and spatially omnidirectional noise, then the minimization by the null beamformer controller 42 would cause the null beamformer signal $S_Z$ to have a rearward cardioid directional characteristic 25 with a null in the forward direction 22, thus suppressing the voice sound V completely also in the case where the first and the second microphone units 11, 12 have different sensitivities.

In a second step, the candidate beamformer controller 45 determines the candidate transfer function $H_W$, of the candidate filter W to equal the complex conjugate of the null transfer function $H_Z$ of the null filter Z. The candidate beamformer controller 45 thus determines the candidate weight vector $B_W$ to be equal to the complex conjugate of the null weight vector $B_Z$. However, it suffices that the candidate beamformer controller 45 determines the candidate weight vector $B_W$ to be congruent with the complex conjugate of the null weight vector $B_Z$.

In the ideal case mentioned above, determining the candidate weight vector $B_W$ to be congruent with the complex conjugate of the null weight vector $B_Z$ will cause the candidate beamformer signal $S_W$ to have the same shape of its directional characteristic as the null beamformer signal $S_Z$ would have with swapped locations of the first and second sound inlets 8, 9, i.e. a forward cardioid 24, which effectively amounts to spatially flipping the rearward cardioid 25 with respect to the forward and rearward directions 22, 23. In the ideal case, the forward cardioid 24 is indeed the optimum directional characteristic for increasing or maximizing the relative amount of voice sound V in the candidate beamformer signal $S_W$. The requirement of complex conjugate congruence ensures that the flipping of the directional characteristic works independently of differences in the sensitivities of the first and the second microphone units 11, 12. For voice sound V arriving from near-field, the directional characteristics obtained are not ideal cardioids, but the flipping by complex conjugation still works to maximize the voice sound V in the candidate beamformer signal $S_W$. Determining the candidate weight vector $B_W$ to be congruent with the complex conjugate of the null weight vector $B_Z$ is an optimum solution. In some embodiments, however, it may suffice to determine the candidate weight vector $B_W$ to define a non-optimum candidate beamformer 44. For instance, the candidate beamformer controller 45 may estimate a null direction indicating the direction of the null of the directional characteristic 25 of the null beamformer 41 in dependence on the null weight vector $B_Z$, and then determine the candidate weight vector $B_W$ to define a cardioid directional characteristic for the candidate beamformer 44 with a null oriented more or less opposite to the estimated null direction, such as e.g. in a direction at least 160° away from the estimated null direction.

In a third step, the auxiliary beamformer controller 34 estimates the performance of the candidate beamformer 44, estimates whether it performs better than the current auxiliary beamformer 33, and in that case, updates the auxiliary transfer function Hr to equal the candidate transfer function $H_W$. The auxiliary beamformer controller 34 thus adaptively determines the auxiliary weight vector Br to be equal to, or just be congruent with, the candidate weight vector $B_W$. The auxiliary beamformer controller 34 may alternatively adaptively determine the auxiliary weight vector $B_F$ to converge towards being equal to, or just congruent with, the candidate weight vector $B_W$. For the performance estimation, the candidate voice detector 46 applies the predefined measure function A to determine a candidate voice measure $V_W$ of voice sound V in the candidate beamformer signal $S_W$. The auxiliary beamformer controller 34 thus adaptively determines the auxiliary weight vector $B_F$ in dependence on the candidate voice measure $V_W$.

The auxiliary beamformer controller 34 may e.g. compare the candidate voice measure $V_W$ to the auxiliary voice measure $V_F$ and update the auxiliary weight vector Br when the candidate voice measure $V_W$ exceeds the auxiliary voice measure $V_F$. Alternatively, or additionally, the auxiliary beamformer controller 34 may compare the candidate voice measure $V_W$ to a voice measure threshold, update the auxiliary weight vector $B_F$ when the candidate voice measure $V_W$ exceeds the voice measure threshold and then also update the voice measure threshold to equal the candidate voice measure $V_W$.

For the performance estimation, the null voice detector 43 may further apply the predefined measure function A to determine a null voice measure $V_Z$ of voice sound V in the null beamformer signal $S_Z$. The auxiliary beamformer controller 34 may adaptively determine the auxiliary weight vector $B_F$ in dependence on the candidate voice measure $V_W$ and the null voice measure $V_Z$.

The voice measure function A may be chosen as a function that simply correlates positively with an energy level or an amplitude of the signal to which it is applied. The output of the voice measure function A may thus e.g. equal an averaged energy level or an averaged amplitude of its input signal. In environments with high noise levels, however, more sophisticated voice measure functions A may be better suited, and a variety of such functions exists in the prior art, e.g. functions that also take frequency distribution into account.

Preferably, the auxiliary beamformer controller 34 determines a candidate beamformer score $E_W$ in dependence on the candidate voice measure $V_W$ and preferably further on the residual voice measure $V_Z$. The auxiliary beamformer controller 34 may thus use the candidate beamformer score $E_W$ as an indication of the performance of the candidate beamformer 44. The auxiliary beamformer controller 34 may e.g. determine the candidate beamformer score $E_W$, as a positive monotonic function of the candidate voice measure $V_W$ alone, as a difference between the candidate voice measure $V_W$ and the residual voice measure $V_Z$, or more preferably, as a ratio of the candidate voice measure $V_W$ to the residual voice measure $V_Z$. In the latter case, the voice measure function A is preferably chosen as a non-zero function to avoid division errors. Using both the candidate voice measure $V_W$ and the residual voice measure $V_Z$ for determining the candidate beamformer score $E_W$ may help to ensure that a candidate beamformer score $E_W$ stays low when adverse conditions for adapting the auxiliary beamformer prevail, such as e.g. in situations with no speech and loud noise. The voice measure function A should be chosen to correlate positively with voice sound V in the respective beamformer signal $S_F$, $S_W$, $S_Z$, and the above suggested computations of the candidate beamformer score $E_W$ should then also correlate positively with the performance of the candidate beamformer 44.

To increase the stability of the beamformer adaptation, the auxiliary beamformer controller 34 preferably determines the candidate beamformer score $E_W$ in dependence on averaged versions of the candidate voice measure $V_W$ and/or the residual voice measure $V_Z$. The auxiliary beamformer controller 34 may e.g. determine the candidate beamformer score $E_W$, as a positive monotonic function of a sum of N consecutive values of the candidate voice measure $V_W$, as a difference between a sum of N consecutive values of the candidate voice measure $V_W$ and a sum of N consecutive values of the residual voice measure $V_Z$, or more preferably, as a ratio of a sum of N consecutive values of the candidate voice measure $V_W$ to a sum of N consecutive values of the residual voice measure $V_Z$, where N is a predetermined positive integer number, e.g. a number in the range from 2 to 100.

The auxiliary voice detector 35 may determine an auxiliary beamformer score $E_F$ according to any of the principles described above for determining the candidate beamformer score $E_W$, however using the auxiliary voice measure $V_F$ as input instead of the candidate voice measure $V_W$. The auxiliary voice detector 35 may further determine a suppression beamformer signal by applying a suppression weight vector to the auxiliary input vector $M_A$, wherein the suppression weight vector is equal to, or is congruent with, the complex conjugate of the auxiliary weight vector $B_F$, determine a suppression voice measure by applying the voice measure function A to the suppression beamformer signal, and use the suppression voice measure instead of the null voice measure $V_Z$ as input for determining the auxiliary beamformer score $E_F$. The auxiliary beamformer score $E_F$ may be a frequency-dependent function. The auxiliary beamformer score $E_F$ may thus reflect or represent the candidate beamformer score $E_W$, however based on the "best" version of the candidate beamformer 44 as represented by the auxiliary beamformer 33.

The auxiliary beamformer controller 34 preferably determines the auxiliary weight vector Br in dependence on the candidate beamformer score $E_W$ exceeding the auxiliary beamformer score $E_F$ and/or a beamformer-update threshold $E_B$, and preferably also increases the beamformer-update threshold $E_B$ in dependence on the candidate beamformer score $E_W$. For instance, when determining that the candidate beamformer score $E_W$, exceeds the auxiliary beamformer score $E_F$ and/or the beamformer-update threshold $E_B$ the auxiliary beamformer controller 34 may update the auxiliary filter F to equal, or be congruent with, the candidate filter W and may at the same time set the beamformer-update threshold $E_B$ equal to equal the determined candidate beamformer score $E_W$. In order to accomplish a smooth transition, the auxiliary beamformer controller 34 may instead control the auxiliary transfer function $H_F$ of the auxiliary filter F to slowly converge towards being equal to, or just congruent with, the candidate transfer function $H_W$ of the candidate filter W. The auxiliary beamformer controller 34 may e.g. control the auxiliary transfer function $H_F$ of the auxiliary filter F to equal a weighted sum of the candidate transfer function $H_W$ of the candidate filter W and the current auxiliary transfer function $H_F$ of the auxiliary filter F. The auxiliary beamformer controller 34 may preferably further determine a reliability score R and determine the weights applied in the computation of the weighted sum based on the determined reliability score R, such that beamformer adaptation is faster when the reliability score R is high and vice versa. The auxiliary beamformer controller 34 may preferably determine the reliability score R in dependence on detecting adverse conditions for the beamformer adaptation, such that the reliability score R reflects the suitability of the acoustic environment for the adaptation. Examples of adverse conditions include highly tonal sounds, i.e. a concentration of signal energy in only a few frequency bands, very high values of the determined candidate beamformer score $E_W$, wind noise and other conditions that indicate unusual acoustic environments. The auxiliary beamformer 33 is thus repeatedly updated to reflect or equal the "best" version of the candidate beamformer 44. The residual voice measure $V_Z$, the candidate beamformer score $E_W$ and/or the beamformer-update threshold $E_B$ may be frequency-dependent functions, and the auxiliary beamformer controller 34 may update the auxiliary weight vector Br only for frequency bands or frequency bins wherein the candidate beamformer score $E_W$ exceeds the auxiliary beamformer score $E_F$ and/or the beamformer-update threshold $E_B$.

The auxiliary beamformer controller 34 preferably lowers the beamformer-update threshold $E_B$ in dependence on a trigger condition, such as e.g. power-on of the microphone apparatus 30, timer events, user input, absence of user voice V etc., in order to avoid that the auxiliary filter F remains in an adverse state, e.g. after a change of the speaker location 7. The auxiliary beamformer controller 34 may e.g. reset the beamformer-update threshold $E_B$ to zero or a predefined low value at power-on or when detecting that the user presses a reset-button or manipulates the microphone arm 5, and/or e.g. regularly lower the beamformer-update threshold $E_B$ by a small amount, e.g. every five minutes. The auxiliary beamformer controller 34 may preferably further reset the auxiliary filter F to a precomputed transfer function $H_{FO}$ when lowering the beamformer-update threshold $E_B$, such that the microphone apparatus 30 learns the optimum directional characteristic anew from a suitable starting point each time. The precomputed transfer function $H_{FO}$ may be predefined when designing or producing the microphone apparatus 30. Additionally, or alternatively, the precomputed transfer function $H_{FO}$ may be computed from an average of transfer functions $H_F$ of the auxiliary filter F encountered during use of the microphone apparatus 30 and further be stored in a memory for reuse as precomputed transfer function $H_{FO}$ after powering on the microphone apparatus 30, such that the microphone apparatus 30 normally starts up with a suitable starting point for learning the optimum directional characteristic.

The auxiliary voice detector 35 may derive the user-voice activity signal VAD from the auxiliary beamformer score $E_F$ or the candidate beamformer score $E_W$ as an indication of when the user 6 is speaking, and may further use the user-voice activity signal VAD for other signal processing, such as e.g. a squelch function or a subsequent noise reduction filter. Preferably, the auxiliary beamformer controller 34 provides the user-voice activity signal VAD in dependence on the auxiliary beamformer score $E_F$ or the candidate beamformer score $E_W$ exceeding a user-voice threshold $E_V$. Preferably, the auxiliary voice detector 35 further provides a no-user-voice activity signal NVAD in dependence on the auxiliary beamformer score $E_F$ or the candidate beamformer score $E_W$ not exceeding a no-user-voice threshold $E_N$, which is lower than the user-voice threshold $E_V$. Using the auxiliary beamformer score $E_F$ or the candidate beamformer score $E_W$ for determination of a user-voice activity signal VAD and/or a no-user-voice activity signal NVAD may ensure improved stability of the signaling of user-voice activity, since the criterion used is in principle the same as the criterion for controlling the auxiliary beamformer. The user-voice threshold $E_V$, the user-voice activity signal VAD, the no-user-voice threshold $E_N$ and/or the no-user-voice activity signal NVAD may be frequency-dependent functions.

In some embodiments, the candidate beamformer score $E_W$ may be determined from an averaged signal, and in that case, the auxiliary voice detector 35 preferably determines the user-voice activity signal VAD and/or the no-user-voice activity signal NVAD from the auxiliary beamformer score $E_F$ to obtain faster signaling of user-voice activity.

Figure 5:
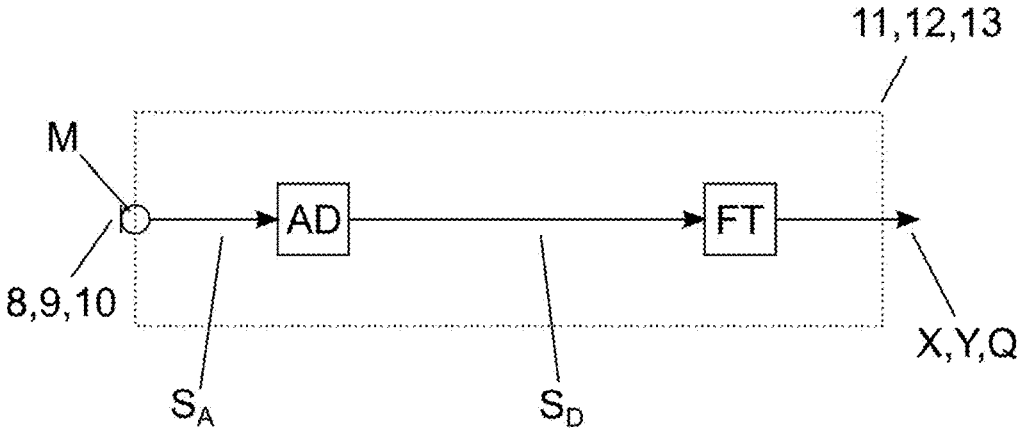
FIG. 5 shows an embodiment of a microphone unit.

Each of the first, second and third microphone units 11, 12, 13 may preferably be configured as shown in FIG. 5. Each microphone unit 11, 12, 13 may thus comprise an acoustoelectric input transducer M that provides an analog microphone signal $S_A$ in dependence on sound received at the respective sound inlet 8, 9, 10, a digitizer AD that provides a digital microphone signal $S_D$ in dependence on the analog microphone signal $S_A$, and a spectral transformer FT that determines the frequency and phase content of temporally consecutive sections of the digital microphone signal $S_D$ to provide the respective input audio signal X, Y, Q as a binned frequency spectrum signal. The spectral transformer FT may preferably operate as a Short-Time Fourier transformer and provide the respective input audio signal X, Y, Q as a Short-Time Fourier transformation of the digital microphone signal $S_D$.

In addition to facilitating filter computation and signal processing in general, spectral transformation of the microphone signals $S_A$ provides an inherent signal delay to the input audio signals X, Y, Q that allows the beamformer weight functions and the linear filters F, Z, W to implement negative delays and thereby enable free orientation of the microphone apparatus 30 with respect to the location of the user's mouth 7. However, where desired, one or more of the beamformer controllers 32, 34, 42, 45 may be constrained to limit the range of directional characteristics. For instance, the null beamformer controller 42 may be constrained to ensure that any null in the directional characteristic of the null beamformer signal $S_Z$ falls within the half space defined by the forward direction 22. Many algorithms for implementing such constraints are known in the prior art.

The null beamformer controller 42 may preferably determine the null transfer function $H_Z$ based on accumulated power spectra derived from the first input audio signal X and the second input audio signal Y. This allows for applying well-known and effective algorithms, such as the finite impulse response (FIR) Wiener filter computation, to minimize the null beamformer signal $S_Z$. If the null mixer JZ is implemented as a subtractor, then the null beamformer signal $S_Z$ will be minimized when the null filtered signal ZY equals the first input audio signal X. FIR Wiener filter computation was designed for solving exactly this type of problems, i.e. for estimating a filter that for a given input signal provides a filtered signal that equals a given target signal. If the mixer JZ is implemented as a subtractor, then the first input audio signal X and the second input audio signal Y can be used respectively as target signal and input signal to a FIR Wiener filter computation that then estimates the wanted null filter Z.

Figure 6:
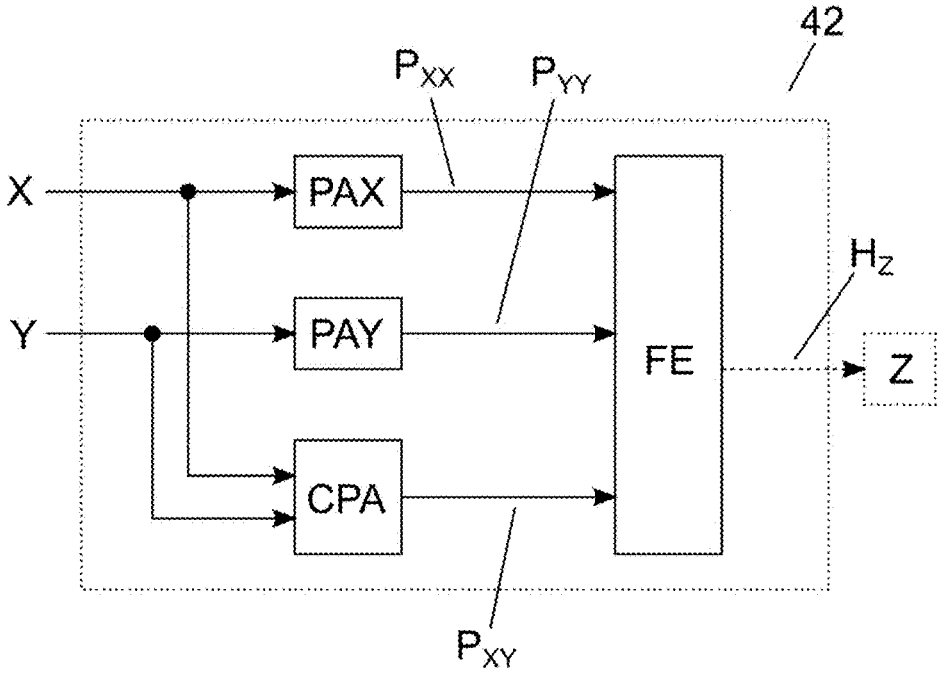
FIG. 6 shows an embodiment of a beamformer controller.

As shown in FIG. 6, the null beamformer controller 42 thus preferably comprises a first auto-power accumulator PAX, a second auto-power accumulator PAY, a cross power accumulator CPA and a filter estimator FE. The first auto-power accumulator PAX accumulates a first auto-power spectrum $P_{XX}$ based on the first input audio signal X, the second auto-power accumulator PAY accumulates a second auto-power spectrum $P_{YY}$ based on the second input audio signal Y, the cross power accumulator CPA accumulates a cross power spectrum $P_{XY}$ based on the first input audio signal X and the second input audio signal Y, and the filter estimator FE controls the null transfer function $H_Z$ of the null filter Z based on the first auto-power spectrum $P_{XX}$, the second auto-power spectrum $P_{YY}$ and the cross-power spectrum $P_{XY}$.

The filter estimator FE preferably controls the null transfer function $H_Z$ using a FIR Wiener filter computation based on the first auto-power spectrum, the second auto-power spectrum and the first cross-power spectrum. Note that there are different ways to perform the Wiener filter computation and that they may be based on different sets of power spectra, however, all such sets are based, either directly or indirectly, on the first input audio signal X and the second input audio signal Y.

Depending on the implementation of the null beamformer controller 42 and the null filter Z, the null beamformer controller 42 does not necessarily need to estimate the null transfer function $H_Z$ itself. For instance, if the null filter Z is a time-domain FIR filter, then the null beamformer controller 42 may instead estimate a set of filter coefficients that may cause the null filter Z to effectively apply the null transfer function $H_Z$.

It will usually be intended that the auxiliary beamformer signal $S_F$ provided by the auxiliary beamformer 33 shall contain intelligible speech, and in this case the auxiliary beamformer 33 preferably operates on input audio signals X, Y which are not or only moderately averaged or otherwise low-pass filtered. Conversely, since the main purpose of the null beamformer signal $S_Z$ and the candidate beamformer signal $S_W$ may be to allow adaptation of the auxiliary beamformer 32, the null beamformer 41 and the candidate beamformer 44 may preferably operate on averaged signals, e.g. in order to reduce computation load. Furthermore, a better adaptation to speech signal variations may be achieved by estimating the null filter Z and the candidate filter W based on averaged versions of the input audio signals X, Y.

Since each of the first auto-power spectrum $P_{XX}$, the second auto-power spectrum $P_{YY}$ and the cross-power spectrum $P_{XY}$ may in principle be considered an average of the respective spectral signal X, Y, Z, these power spectra may also be used for determining the candidate voice measure $V_W$ and/or the residual voice measure $V_Z$. Correspondingly, the null filter Z may preferably take the second auto-power spectrum $P_{YY}$ as input and thus provide the null filtered signal ZY as an inherently averaged signal, the null mixer JZ may take the first auto-power spectrum $P_{XX}$ and the inherently averaged null filtered signal ZY as inputs and thus provide the null beamformer signal $S_Z$ as an inherently averaged signal, and the residual voice detector 43 may take the inherently averaged null beamformer signal $S_Z$ as an input and thus provide the residual voice measure $V_Z$ as an inherently averaged signal.

Similarly, the candidate filter W may preferably take the second auto-power spectrum $P_{YY}$ as input and thus provide the candidate filtered signal WY as an inherently averaged signal, the candidate mixer JW may take the first auto-power spectrum $P_{XX}$ and the inherently averaged candidate filtered signal WY as inputs and thus provide the candidate beamformer signal $S_W$ as an inherently averaged signal, and the candidate voice detector 46 may take the inherently averaged candidate beamformer signal $S_W$ as an input and thus provide the candidate voice measure $V_W$ as an inherently averaged signal.

The first auto-power accumulator PAX, the second auto-power accumulator PAY and the cross-power accumulator CPA preferably accumulate the respective power spectra over time periods of 50-500 ms, more preferably between 150 and 250 ms, to enable reliable and stable determination of the voice measures $V_W$, $V_Z$.

The candidate beamformer controller 45 may preferably determine the candidate transfer function $H_W$ by computing the complex conjugation of the null transfer function $H_Z$. For a filter in the binned frequency domain, complex conjugation may be accomplished by complex conjugation of the filter coefficient for each frequency bin. In the case that the configuration of the candidate mixer JW differs from the configuration of the null mixer JZ, then the candidate beamformer controller 45 may further apply a linear scaling to ensure correct functioning of the candidate beamformer 44. The candidate beamformer controller 45 may generally determine the candidate weight vector as the complex conjugation of the weight vector $B_Z$.

In the case that the auxiliary filter F, the null filter Z and the candidate filter W are implemented as FIR time-domain filters, then the null transfer function $H_Z$ may not be explicitly available in the microphone apparatus 30, and then the candidate beamformer controller 45 may compute the candidate filter W as a copy of the null filter Z, however with reversed order of filter coefficients and with reversed delay. Since negative delays cannot be implemented in the time domain, reversing the delay of the resulting candidate filter W may require that an adequate delay has been added to the signal used as X input to the candidate mixer JW. In any case, one or both of the first and second microphone units 11, 12 may comprise a delay unit (not shown) in addition to—or instead of—the spectral transformer FT in order to delay the respective input audio signal X, Y.

In the case that the first and second audio input signals X, Y have different delays relative to the sound at the respective sound inlets 8, 9, then the flipping of the directional characteristic will typically produce a directional characteristic of the candidate beamformer 44 with a different type of shape than the directional characteristic of the null beamformer 41. Depending on the delay difference, the flipping may e.g. produce a forward hypercardioid characteristic from a rearward cardioid 25. This effect may be utilized to adapt the candidate beamformer 44 to specific usage scenarios, e.g. specific spatial noise distributions and/or specific relative speaker locations 7. The auxiliary beamformer controller 34 and/or the candidate beamformer controller 45 may be adapted to control a delay provided by one or more of the spectral transformers FT and/or the delay units, e.g. in dependence on a device setting, on user input and/or on results of further signal processing.

In some embodiments, like e.g. in the headset 1 shown in FIG. 1, the straight line 21 defined by the first and the second sound inlets 8, 9 may also pass through the third sound inlet 10. In such embodiments, the microphone apparatus 30 may comprise a further auxiliary controller 40, and the main beamformer controller 32 may determine the steering vector $d_M$ in further dependence on a further auxiliary weight vector $B_F$ determined for a further auxiliary beamformer 33 of the further auxiliary controller 40. The further auxiliary beamformer 33 may then operate on a further auxiliary input vector $M_A$ constituted by the first and the third microphone inputs X, Q or constituted by the second and the third microphone inputs Y, Q. The main beamformer controller 32 may e.g. determine the steering vector $d_M$ to be congruent with both the auxiliary weight vector $B_F$ and the further auxiliary weight vector $B_F$ and will thus not need to determine the third main weight vector component $B_{MQ}$ by other methods. For instance, if the main beamformer controller 32 has determined the steering vector components $d_{MX}$ and $d_M y$ as described further above, and the further auxiliary beamformer controller 34 has determined the further auxiliary weight vector $B_F=(B_{FX2}, B_{FQ})$ for the first and the third microphone inputs X, Q, then the main beamformer controller 32 may e.g. determine the steering vector component $d_{MQ}$ for the third input audio signal Q based on the formula: $d_{MQ}=d_{MX}/B_{FX2}\times B_{FQ}$. This principle may be expanded to embodiments with main microphone arrays 14 having more than three, such as e.g. four, five or six microphones units 11, 12, 13 with sound inlets 8, 9, 10 arranged on the straight line 21.

In embodiments with main microphone arrays 14 having three or more, such as e.g. four, five, six, seven, eight or even more microphone units 11, 12, 13 with sound inlets 8, 9, 10 that are not all arranged on the straight line 21, the microphone apparatus 30 may comprise multiple auxiliary controllers 40, such as e.g. two, three, four or even more, and the main beamformer controller 32 may determine the steering vector $d_M$ in dependence on two or more auxiliary weight vectors $B_F$ determined for respective auxiliary beamformers 33 of the multiple auxiliary controllers 40. In such embodiments, the microphone apparatus 30 should generally be designed such that if any two auxiliary beamformers 33 operate on microphone inputs X, Y, Q from microphone units 11, 12, 13 with sound inlets 8, 9, 10 that are not arranged on one and the same straight line 21, then these auxiliary beamformers 33 should not share any of their microphone inputs X, Y, Q. Otherwise, the main beamformer controller 32 may fail to accurately determine steering vector $d_M$. This may e.g. apply to main microphone arrays 14 having microphone units 11, 12, 13 with sound inlets 8, 9, 10 on both earphones 2, 3 of a headset 1.

The auxiliary beamformer 33 will normally perform better when the auxiliary microphone array 15 is oriented such that the straight line 21 extends approximately in the direction of the user's mouth 7. The microphone apparatus 30 should thus preferably be designed to nudge or urge a user 6 to arrange the auxiliary microphone array 15 accordingly, e.g. like in the headset 1 shown in FIG. 1. In embodiments with main microphone arrays 14 having microphone units 11, 12, 13 with sound inlets 8, 9, 10 that are not all arranged on the straight line 21, and with two or more auxiliary controllers 40, the respective auxiliary beamformers 33 may not perform equally well. In order to address this, the main beamformer controller 32 may select a proper subset of the available auxiliary beamformers 33, e.g. based on their auxiliary beamformer score $E_F$, and determine the steering vector $d_M$ to be congruent only with auxiliary weight vectors $B_F$ determined for auxiliary beamformers 33 in the selected subset. The main beamformer controller 32 may include in the subset e.g. only one or only two auxiliary beamformers 33 that have the higher auxiliary beamformer score $E_F$ of all available auxiliary beamformers 33. In embodiments wherein one or more auxiliary beamformers 33 are by design arranged more favorably, these auxiliary beamformers 33 may be selected over other auxiliary beamformers 33 even if they have a lower auxiliary beamformer score $E_F$ than the other auxiliary beamformers 33. The main beamformer controller 32 may alternatively, or additionally, apply similar logic to determine from which of two or more auxiliary controllers 40 to accept a user-voice activity signal VAD or a no-user-voice activity signal NVAD.

Although the examples disclosed herein are based on a main beamformer 31 configured as a MVDR beamformer, the principles of the present disclosure may be adapted to other adaptive beamformer types that require a steering vector, a user-voice activity signal VAD and/or a no-user-voice activity signal NVAD for proper operation.

Functional blocks of digital circuits may be implemented in hardware, firmware or software, or any combination hereof. Digital circuits may perform the functions of multiple functional blocks in parallel and/or in interleaved sequence, and functional blocks may be distributed in any suitable way among multiple hardware units, such as e.g. signal processors, microcontrollers and other integrated circuits.

The detailed description given herein and the specific examples indicating preferred embodiments of the invention are intended to enable a person skilled in the art to practice the invention and should thus be regarded mainly as an illustration of the invention. The person skilled in the art will be able to readily contemplate further applications of the present invention as well as advantageous changes and modifications from this description without deviating from the scope of the invention. Any such changes or modifications mentioned herein are meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt devices according to the invention to specific requirements.

Any reference numerals and labels in the claims are intended to be non-limiting for the scope of the claims.

The invention claimed is:

1. A microphone apparatus adapted to provide a main output audio signal in dependence on voice sound received from a user of the microphone apparatus, the microphone apparatus comprising:

a main microphone array with a first microphone unit adapted to provide a first input audio signal in dependence on sound received at a first sound inlet, a second microphone unit adapted to provide a second input audio signal in dependence on sound received at a second sound inlet spatially separated from the first sound inlet and a third microphone unit adapted to provide a third input audio signal in dependence on sound received at a third sound inlet spatially separated from the first and the second sound inlet, whereby the main microphone array is defined to provide a main input vector comprising as components the first, the second and the third input audio signal;

a main beamformer adapted to provide the main output audio signal as a beamformed signal by applying a main weight vector to the main input vector; and a main beamformer controller adapted to repeatedly determine a main steering vector and adaptively determine the main weight vector in dependence on the main steering vector and the main input vector to increase the relative amount of voice sound from the user in the main output audio signal, wherein the main steering vector indicates a desired response of the main beamformer;

characterized in that the microphone apparatus further comprises:

an auxiliary beamformer adapted to provide an auxiliary beamformer signal as a beamformed signal by applying an auxiliary weight vector to an auxiliary input vector comprising as components the first and the second input audio signal; and an auxiliary beamformer controller adapted to adaptively determine the auxiliary weight vector to increase the relative amount of voice sound from the user in the auxiliary beamformer signal;

wherein the main beamformer controller further is adapted to determine the main steering vector in dependence on the auxiliary weight vector.

2. A microphone apparatus according to claim 1, further comprising:

a candidate beamformer adapted to provide a candidate beamformer signal as a beamformed signal by applying a candidate weight vector to the auxiliary input vector; and a candidate beamformer controller adapted to adaptively determine the candidate weight vector to increase the relative amount of voice sound from the user in the candidate beamformer signal;

wherein the auxiliary beamformer controller further is adapted to determine the auxiliary weight vector to be congruent with, or converge towards being congruent with, the candidate weight vector in dependence on the candidate beamformer signal.

3. A microphone apparatus according to claim 2, further comprising:

a null beamformer adapted to provide a null beamformer signal as a beamformed signal by applying a null weight vector to the auxiliary input vector; and a null beamformer controller adapted to adaptively determine the null weight vector to decrease the relative amount of voice sound from the user in the null beamformer signal;

wherein the candidate beamformer controller further is adapted to determine the candidate weight vector in dependence on the null weight vector and the null beamformer signal.

4. A microphone apparatus according to claim 3, wherein the candidate beamformer controller further is adapted to determine the candidate weight vector to be congruent with, or converge towards being congruent with, the complex conjugate of the null weight vector in dependence on the null beamformer signal.

5. A microphone apparatus according to claim 4, wherein the main beamformer controller further is adapted to determine the main steering vector to be congruent with, or converge towards being congruent with, the auxiliary weight vector.

6. A microphone apparatus according to claim 5, wherein the main beamformer controller further is adapted to determine the main steering vector to be equal to, or converge towards being equal to, the auxiliary weight vector.

7. A microphone apparatus according to claim 6, further comprising an auxiliary voice detector adapted to apply a voice measure function to determine an auxiliary voice measure of voice sound in the auxiliary beamformer signal; wherein the main beamformer controller further is adapted to determine the main steering vector in dependence on the auxiliary voice measure.

8. A microphone apparatus according to claim 7, further comprising a candidate voice detector adapted to apply a voice measure function to determine a candidate voice measure of voice sound in the candidate beamformer signal; wherein the main beamformer controller further is adapted to determine the main steering vector in dependence on the candidate voice measure.

9. A microphone apparatus according to claim 8, further comprising a residual voice detector adapted to apply a voice measure function to determine a residual voice measure of voice sound (V) in the null beamformer signal; wherein the main beamformer controller further is adapted to determine the main steering vector in dependence on the residual voice measure.

10. A microphone apparatus according to claim 9, wherein the auxiliary beamformer controller further is adapted to:

determine a candidate beamformer score in dependence on the candidate voice measure ($V_W$) and the residual voice measure;

determine the auxiliary weight vector in further dependence on the candidate beamformer score exceeding a first threshold; and increase the first threshold in dependence on the candidate beamformer score.

11. A microphone apparatus according to claim 10, wherein:

the auxiliary beamformer controller further is adapted to provide a user-voice activity signal in dependence on a beamformer score exceeding a second threshold; and the main beamformer controller further is adapted to determine the main steering vector in dependence on the user-voice activity signal.

12. A microphone apparatus according to claim 11, wherein:

the auxiliary beamformer controller further is adapted to provide a no-user-voice activity signal in dependence on a beamformer score not exceeding a third threshold, wherein the third threshold is lower than the second threshold; and the main beamformer controller further is adapted to determine the main steering vector in dependence on the no-user-voice activity signal.

13. A microphone apparatus according to claim 12, further comprising two or more auxiliary beamformers, each operating on a different set of two input audio signals among said first input audio signal, said second input audio signal and said third input audio signal, wherein the main beamformer controller further is adapted to determine the main steering vector in dependence on two or more auxiliary weight vectors determined by two or more auxiliary beamformer controllers for respective ones of the two or more auxiliary beamformers.

14. A microphone apparatus according to claim 13, wherein:

each of the two or more auxiliary beamformer controller is adapted to determine an auxiliary beamformer score for a respective one of the two or more auxiliary beamformers; and the main beamformer controller further is adapted to determine the main steering vector in dependence on a comparison of the auxiliary beamformer scores determined for the two or more auxiliary beamformers.

15. A headset comprising a microphone apparatus according to claim 14.

* * * * *